United States Patent [19]

Merl

[11] 4,212,506

[45] Jul. 15, 1980

[54] MULTI-COMPARTMENT DISPLAY DEVICE

[75] Inventor: Milton J. Merl, New City, N.Y.

[73] Assignee: Marlboro Marketing, Inc., New York, N.Y.

[21] Appl. No.: 970,335

[22] Filed: Dec. 18, 1978

[51] Int. Cl.[2] ..... A47B 57/00

[52] U.S. Cl. ..... 312/118; 312/140.1; 312/140.4; 211/184; 108/61

[58] Field of Search ..... 312/140.1, 140.4, 117, 312/118, 119, 120, 121, 122, 127, 278, 279; 108/60, 61; 211/184; 206/44 R; 248/DIG. 9

[56] References Cited

U.S. PATENT DOCUMENTS

| | | | |
|---|---|---|---|
| 1,215,882 | 2/1917 | Simonds et al. | 312/140 |
| 1,452,242 | 4/1923 | Jensen | 312/118 |
| 1,985,582 | 12/1934 | Schwinger | 248/DIG. 9 |
| 2,333,717 | 11/1943 | Heed et al. | 312/278 |
| 2,481,485 | 12/1969 | Hess | 108/61 |
| 2,532,600 | 2/1950 | Broersma | 211/184 |
| 2,812,852 | 11/1957 | Samuels | 206/44 R |
| 3,720,451 | 3/1973 | Anders | 211/184 |
| 3,872,976 | 3/1975 | Moore et al. | 312/140.4 |
| 4,084,702 | 4/1978 | Lucchitta | 211/184 |

FOREIGN PATENT DOCUMENTS

| | | | |
|---|---|---|---|
| 466689 | 5/1947 | Canada | 248/DIG. 9 |
| 298092 | 4/1954 | Switzerland | 312/140.4 |

*Primary Examiner*—Victor N. Sakran

*Attorney, Agent, or Firm*—Mark T. Basseches; Paula T. Basseches

[57] ABSTRACT

The present invention is directed to a merchandising device, and more particularly to a counter organizer device adapted to divide an elongate counter into a series of bins or receptacles for the display of merchandise. The device is characterized in particular by the provision of a kit of stock parts, shipped in knocked condition and readily assembled, the device being adaptable to organize or subdivide shelves of various heights and depths.

10 Claims, 15 Drawing Figures

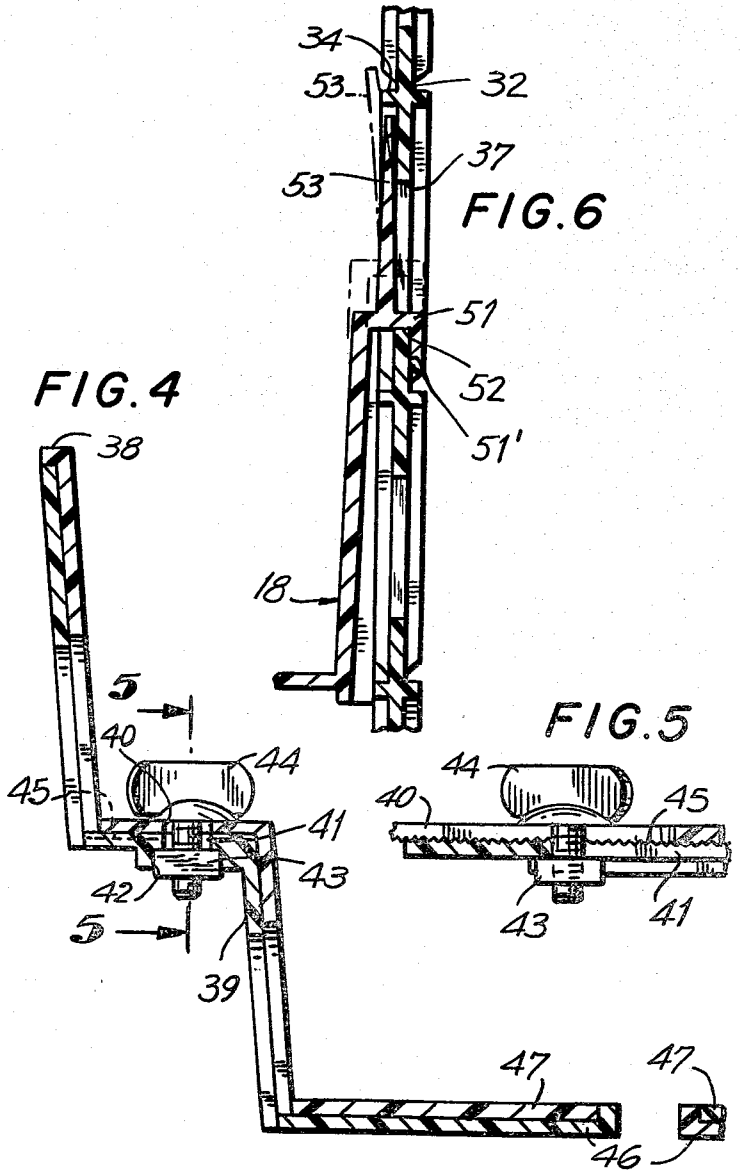
FIG. 6
32
37
51
52
51'
34
53
53
18
FIG. 5
45
41
44
43
40
47
46
47
39
FIG. 4
44
41
43
40
42
5
5
38
45
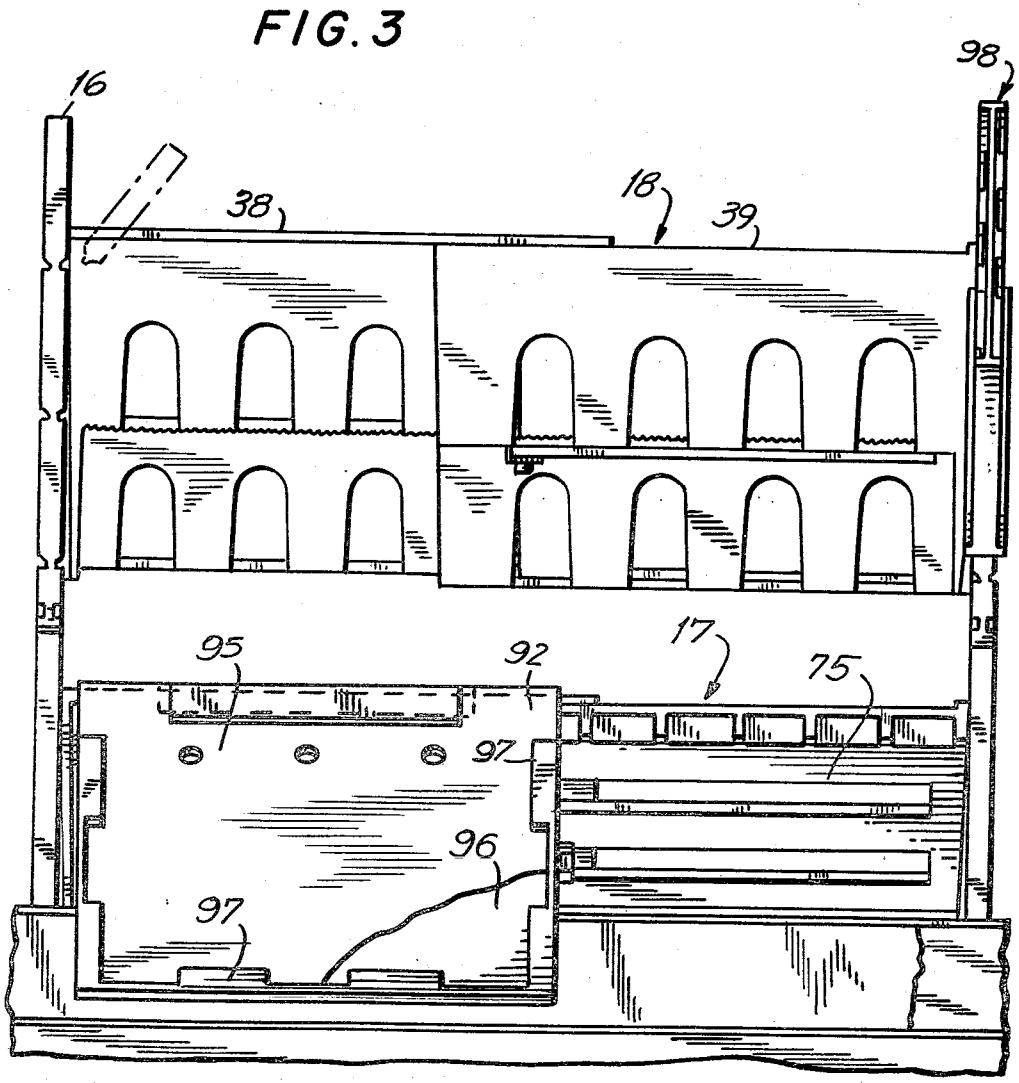
FIG. 3
98
39
18
75
17
92
97
96
38
95
97
16

MULTI-COMPARTMENT DISPLAY DEVICE

BACKGROUND OF THE INVENTION

1. Field of the Invention

The present invention is in the field of merchandising display devices and pertains more particularly to a display device for use on supermarket shelves or in like applications where shelf space is at a premium and thus must be organized for maximum efficiency and attractiveness.

2. The Prior Art

In the display of merchandise for sale in supermarkets or like environments, it is highly desirable, for the attractive and efficient display, that the individual items be maintained in discrete, orderly and visually accessible arrangement. Numerous systems have heretofore been proposed for the accomplishment of these objectives.

Typically, since display areas available vary from location to location, it has been necessary to fabricate to order shelf divider systems specifically intended for a given location. In a typical arrangement, an elongate shelf will be used to store in side by side disposition stocks of a variety of different articles or related articles of different brands. In order that the stocks be separated for customer identification, and to facilitate restocking, it is highly desirable to provide a series of vertically directed subdivisions of the shelf space. Often experience dictates modification of the space allocations. For instance, where sales of a given product exceed or fall below expectations, it is desirable to increase or reduce the shelf space assigned to the product. Obviously, the use of a built-in vertical subdivision precludes the ready reorganization of the assigned shelf space. Additionally, fabrication to order of vertical subdivisions is costly and time consuming.

SUMMARY OF THE INVENTION

The present invention may be summarized as directed to a counter or shelf display and organizer device which may be supplied in knocked-down condition as a kit, to be readily erected on the site, the assembled device providing an attractive and efficient means for displaying merchandise.

The device is characterized by the ability of a single basic series of construction modules to be readily adapted to fit on storage shelves of different heights and depths, whereby a single kit of parts may be accommodated to a multiplicity of merchandising environments.

More particularly, the invention is directed to a device of the type described which may be readily altered after installation to allow for changing merchandising requirements.

Still more particularly, the invention relates to a shelf organizer device for use on an elongate shelf, the device including an elongate front runner member or members and a multiplicity of vertically directed divider members adapted to be secured to the runner at longitudinally displaced positions therealong in accordance with the desired compartmentalization of the space.

A plurality of longitudinally expansible bin members or assemblies are arranged to be interposed between adjacent pairs of dividers. The dividers are characterized by the inclusion of a multiplicity of vertically and horizontally directed receiver apertures which provide alternative anchor points for the bins. In addition, the dividers include vertically and horizontally directed score lines extending between the receiver apertures whereby the height and depth of the dividers may be modified by simply fracturing the dividers along a predetermined score line or lines to accommodate the dividers to existing counter or shelf configurations.

It is accordingly an object of the present invention to provide an inexpensive and attractive shelf organizer display device whereby an elongate display shelf, such as may be found in a supermarket, may be subdivided into a series of side by side dispensing bins or compartments.

A further object of the invention is the provision of a device of the type described which may be shipped in knocked-down condition and readily assembled at the job site by unskilled help, the device being readily accommodated to various shelf depths and heights.

A further object of the invention is the provision of a device of the type described which includes a front runner and a plurality of standard sized dividers adapted to be attached to the front runner at selected longitudinal positions therealong, the dividers being readily accommodated to a given shelf height and depth without the use of saws or other tools.

Still a further object of the invention is the provision of a shelf organizer device of the type described which, after initial set up, may be readily modified in accordance with changed marketing conditions, enabling the spacing of adjacent bins or compartments to be increased or decreased, as desired.

A still further object of the invention is the provision of a device of the type described wherein virtually all of the component parts may be fabricated of inexpensive molded plastic material which, in the assembled condition, provides a three dimensional, rugged series of bins or compartments.

To attain these objects and such further objects as may appear herein or be hereinafter pointed out, reference is made to the accompanying drawings, forming a part hereof, in which:

FIG. 1*a* is a perspective view, on a diminished scale, of a multiple unit organizer set up on a display area;

FIG. 3 is a front elevational view of the said device;

FIG. 4 is a magnified section taken on the line 4—4 of FIG. 1;

FIG. 5 is a magnified vertical section taken on the line 5—5 of FIG. 4;

FIG. 6 is a vertical section taken on the line 6—6 of FIG. 2;

Figure 1:
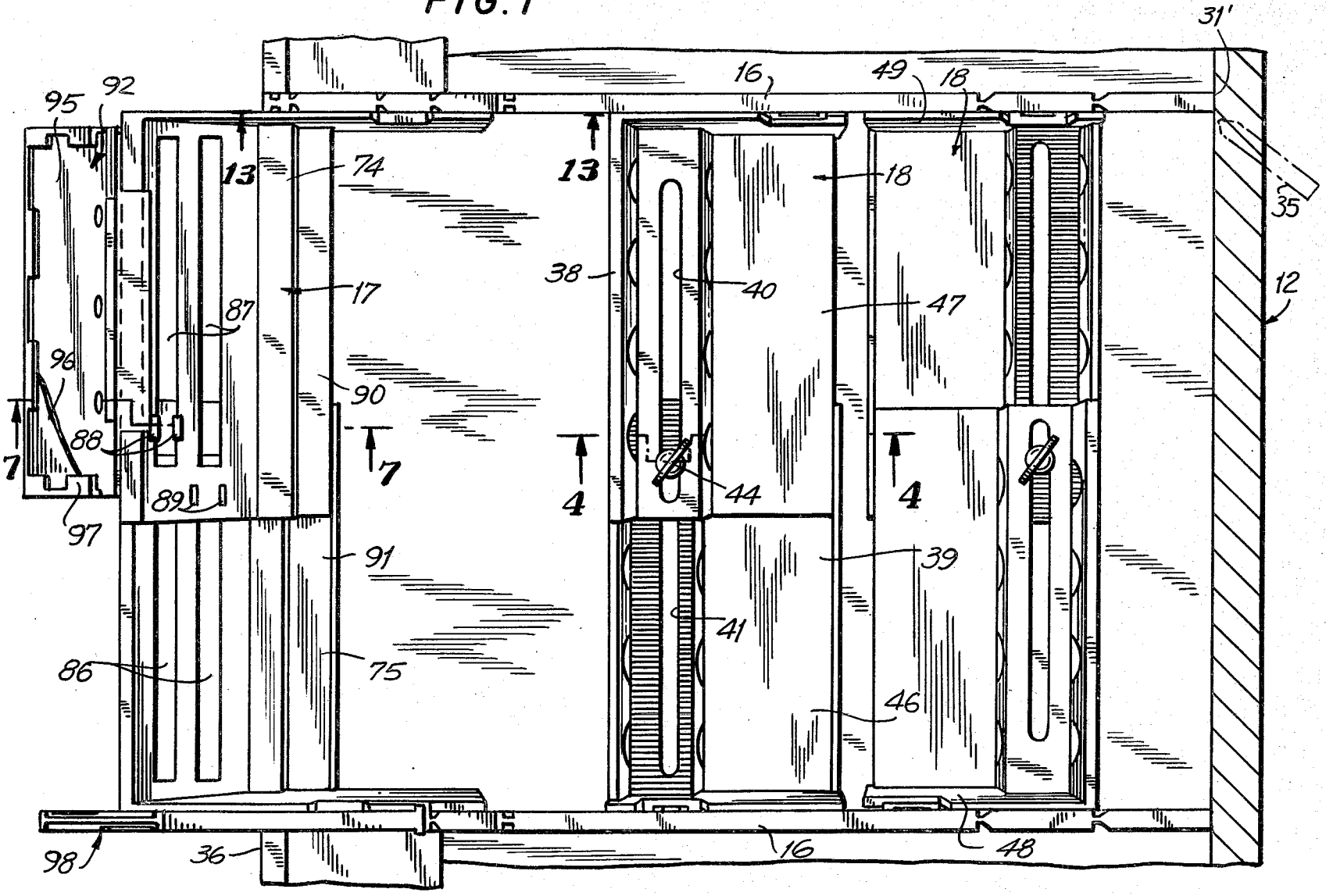
FIG. 1 is a top plan view of an individual merchandising compartment in accordance with the invention.
Figure 1A:
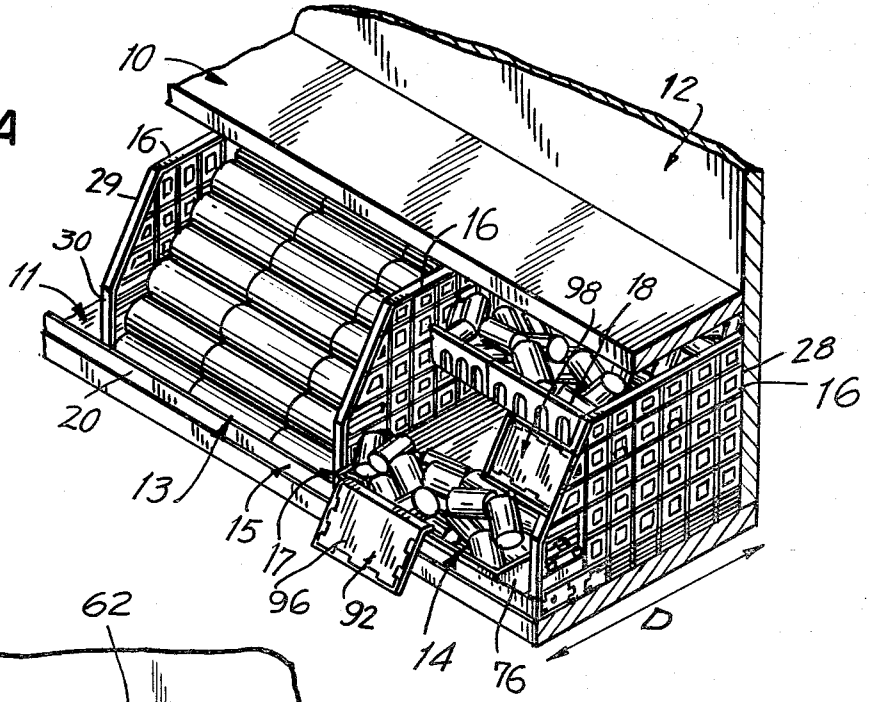
FIG. 1A is a perspective view of an assemblage in accordance with the invention.

In FIG. 1*a* there is depicted a typical supermarket shelf arrangement comprising a series of horizontally directed merchandising shelves 10, 11 extending forwardly from a partition 12. As is typical, the depth of each successively lower shelf is increased as respects each upper shelf, to provide a staggered arrangement for ready access by the purchaser.

As is typical, food stuffs or like articles of packaged merchandise are displayed in individual segments or bins arrayed on the shelves. It is the principal objective of the present invention to provide a subdivider or shelf organizer arrangement whereby one or more separate compartments 13, 14 may be readily erected lengthwisely along the shelves from a kit or series of stock parts supplied to the merchandiser. The parts are intended to be subject to simple manipulative steps by the merchandiser, enabling the parts to be accommodated to the depth D of the shelf, as well as to the height H or spacing between adjacent shelves.

The principal parts of the display device include a front runner member 15, a series of divider portions 16 secured at their front end to the runner, a front stop or bin assembly 17 and one or more rear bin assemblies 18, the bin assemblies being suspended between adjacent dividers.

Figure 2:
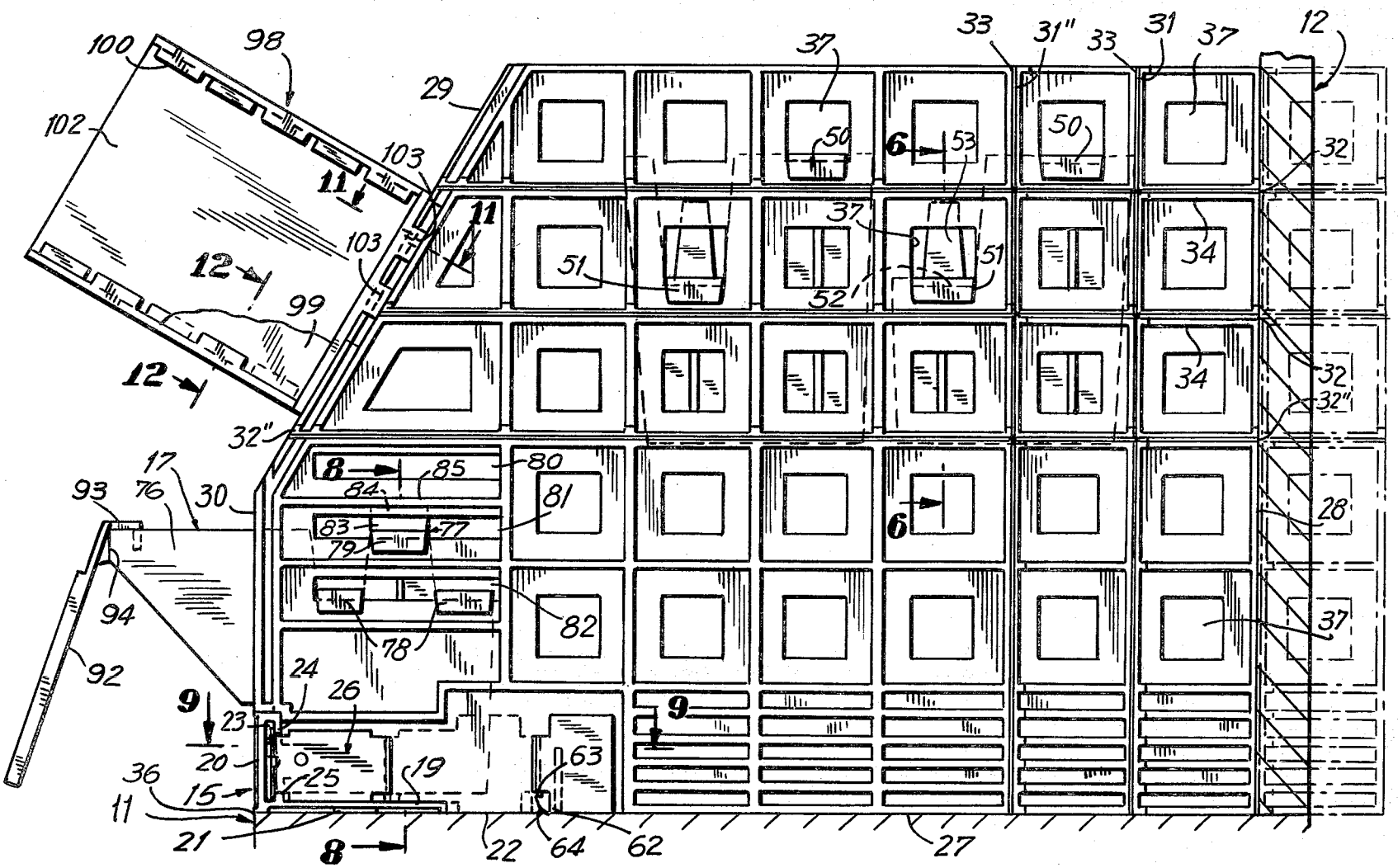
FIG. 2 is a side elevational view of the merchandising device in accordance with FIG. 1.

The front runner assembly, as best seen from FIG. 2, is comprised of an elongate length of rigid extruded plastic material of general L-shaped configuration, including a horizontal leg 19 and a vertical leg 20. Optionally but preferably, the under surface or leg 19 is recessed, the recess being partly filled with a double adhesive mounting tape 21, one surface of which is adhesively connected to the leg 19 and the under or exposed surface of which is adapted to be secured to the upper face 22 of the shelf 11. The under surface of the tape is typically protected by a strippable release covering which is removed at the time of application of the runner to the shelf.

The runner 15 includes an internal channel 23 defined by depending upper and lower rib portions 24, 25.

As will be more fully appreciated hereinafter, clamp members 26 mounted to the dividers 16 are secured within the channel 23 of the runner 15 at selected positions therealong. The divider members 16, which are likewise molded of rigid polymeric material, include a linear base portion 27 and linear back portion 28 perpendicular to the base.

The front portions of the dividers preferably include a sloped front upper face 29 extending a major portion of the depth of the dividers, the lower front face portion 30 of the dividers being vertically directed.

The dividers 16 include a plurality of vertically and horizontally oriented weakened score lines 31, 32, respectively, the portions of the dividers adjacent the score lines incorporating on each side of the divider projecting reinforcing ribs, e.g. vertically running ribs 33 and horizontally running ribs 34—see FIG. 1.

By virtue of the presence of the score lines 31 and 32, it is rendered possible to accommodate the dividers to shelf installations of a variety of sizes by the expedient of flexing and fracturing portions of the dividers along the score lines. See, for instance, upper right hand corner of FIG. 1 wherein a vertically extending portion or column 35 of the divider is being fractured along score line 31' to accommodate the depth of the divider to the distance between the rear partition 12 and the front edge 36 of the shelf 11.

It will be readily recognized that in similar fashion where the height between shelves 12 and 11 dictates, a horizontally running portion of the dividers may be fractured by bending along one of the score lines 32 provided in the divider.

For purposes of rigidity, the area between the front of the divider and bounded by the score lines 32'', 31'' is free of further score lines since it is unlikely that the size of the divider will require reduction below the dimensions defined within the noted confines.

The dividers incorporate a multiplicity of regularly spaced through-going receiver apertures 37 which provide anchor points for the distal ends of the rear bin or bins 18.

As best seen, for instance, by reference to FIG. 3, the rear bin or bins 18 are comprised of two overlapping sections or segments 38 and 39. The bins may be accommodated to variable widthwise spacing of the dividers by varying the degree of overlap of the segments 38, 39. To this end, the bin segments 38, 39 include longitudinally directed elongate slots 40, 41, respectively, which lie in registry with each other in the assembled condition of the bin. The lower segment 39 includes a depending slideway 42, dimensioned slidably but non-rotatably to receive the perimeter of a nut member 43. A wing bolt 44 extends downwardly through the aligned slots 40, 41, and is threadably connected into the captive nut 43.

The opposed faces of the segments 38, 39 are provided with mating corrugations 45 (see FIG. 5) in the area surrounding the slots 40, 41, whereby, when the wing bolt 44 is tightened, the overlapping segments 38, 39 are non-slidably clamped together. Preferably, in order to lend additional structural rigidity to the assembly, the lower segment 39 may include a support ledge 46 and the upper segment may include a tray member 47 slidably received within the ledge 46.

The distal or outermost ends 48, 49 of the rear bins 18 are provided with mounting means adapted to be snapped into position within the receiver apertures 37 of a spaced pair of dividers.

The specific construction of the mounting means is best appreciated from an inspection of FIGS. 2 and 6. Each distal end of a bin includes a pair of hook members 50, 51 (see FIG. 2) which are horizontally and vertically displaced one from the other, the degree of displacement being such as to permit the hooks to be inserted through an adjacent diagonally related pair of receiver apertures. In the inserted position, as shown in solid lines, FIG. 6, the hooks engage over the uppermost surfaces or ledges 52 defining the undermost portion of the receiver apertures, supporting the bins in position against a downward force. In order to assure that the bins may not be dislodged inadvertently upwardly, the distal ends of the bins are provided with resilient locking tongues 53.

Referring again to FIG. 6, locking of the end portions of the bins to the dividers is effected by urging the hooks 50, 51 laterally through the desired receiver aperture in such manner that the lower end of the hooks clear the uppermost surfaces or ledges 52 of the apertures and the vertical wall portion 51' to the opposite side of the divider from the main body of the bin.

As will be apparent from FIG. 6, the lateral movement noted will result in a deflection of the resilient locking tongue portion 53 to the dot and dash position shown in FIG. 6.

With the portion positioned as noted, the bin is moved downward, whereby the hook is engaged against the ledge 52 and the tongue 53 is brought to a level below the horizontal rib 34. It will be observed that when the tongue is positioned below the rib, it will snap outwardly and underlie the rib (solid line position, FIG. 6), whereby the same cannot be disengaged by an upward vertical movement.

In order to effect disassembly of the bin from the divider, it is necessary manually to deflect tongue 53 inwardly so as to be laterally displaced from the rib 34, whereupon the bin may be lifted and removed.

From the foregoing description it will be appreciated that both distal edges of the bin are provided with identical latching arrangements, whereby a bin is fixed between parallel dividers by simultaneously passing the connector latch assemblies through the appropriate apertures with the bin in a somewhat elevated position and forceably shifting the bin downwardly to secure the snap-in arrangement discussed above.

Preferably the bin segments are permitted to remain relatively movable until after the same have been assembled to the divider, whereupon the two bin halves are locked together by tightening the wing bolt 44.

Figure 13:
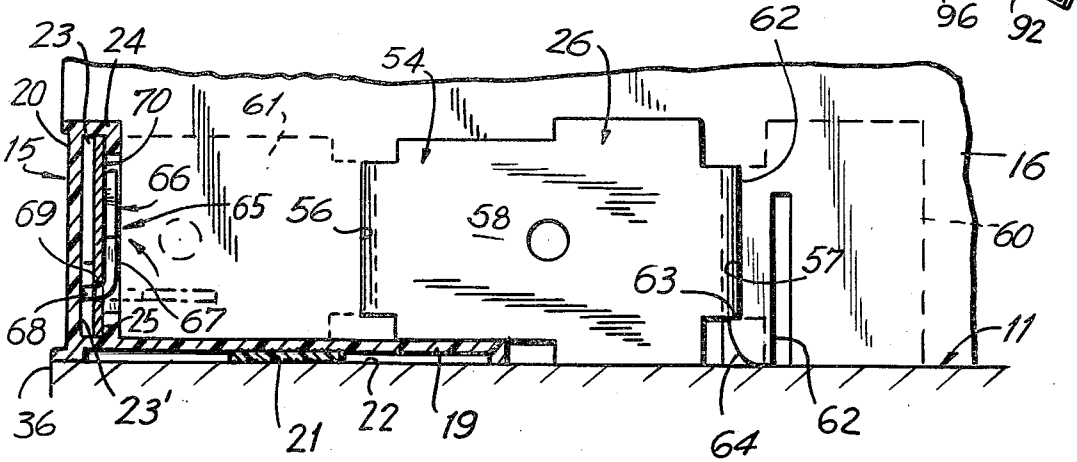
FIG. 13 is a section taken on the line 13—13 of FIG. 1, showing the latching elements securing the dividers to the front runner.
Figures 7, 8, 9, 10, 11, 12:
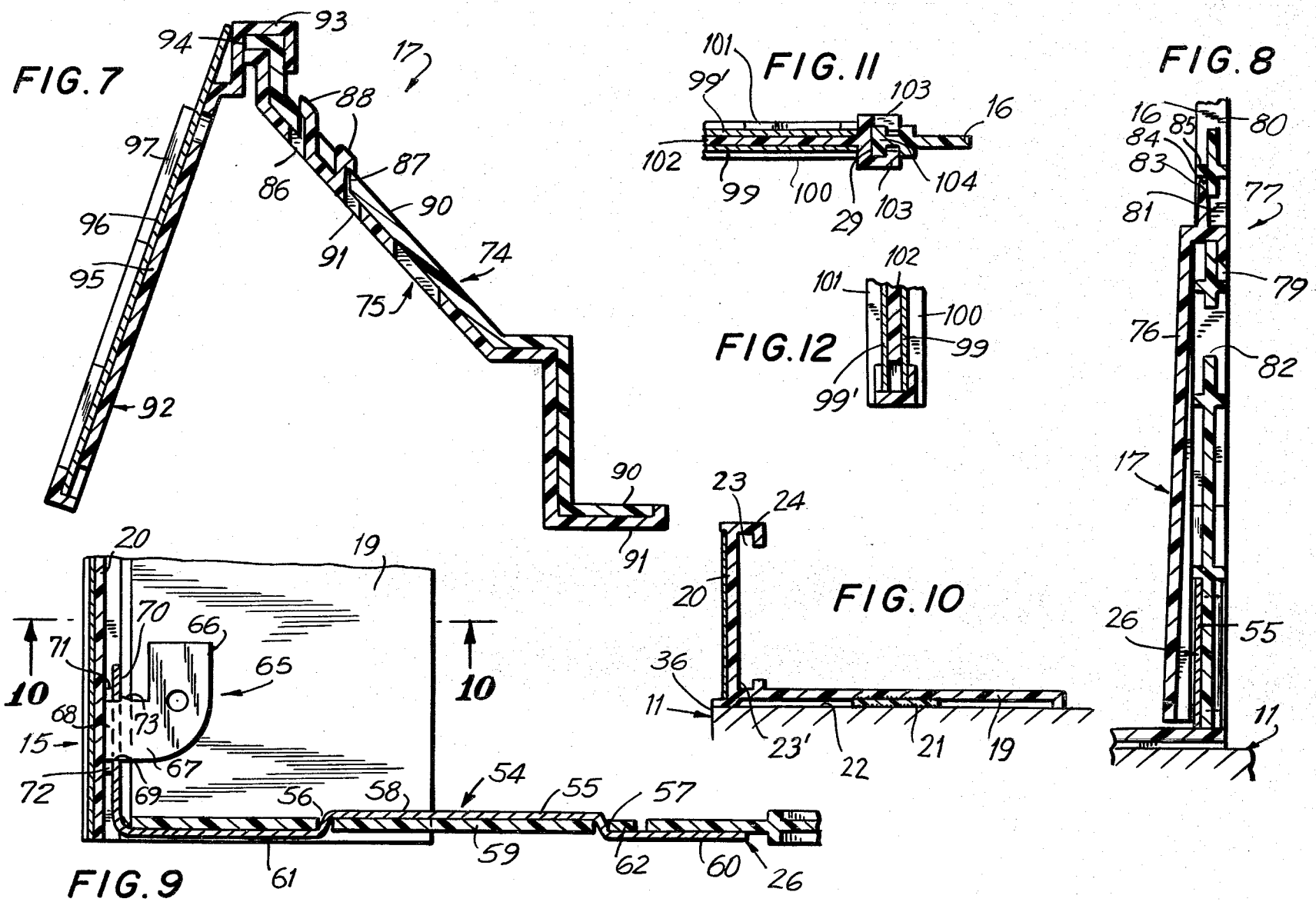
FIG. 7 is a vertical section taken on the line 7—7 of FIG. 1.
FIG. 8 is a section taken on the line 8—8 of FIG. 2.
FIG. 9 is a horizontal section taken on the line 9—9 of FIG. 2.
FIG. 10 is a vertical section taken on the line 10—10 of FIG. 9.
FIG. 11 is a section taken on the line 11—11 of FIG. 2.
FIG. 12 is a section taken on the line 12—12 of FIG. 2.

Connection between the front end of the dividers and the runner is effected by a metal insert member 54 shown in detail in FIGS. 2, 9 and 13.

More specifically, the insert member 54 which, in horizontal section is generally L-shaped, includes an attachment leg portion 55 adapted to be received in spaced, vertically directed slots 56, 57 of the dividers 16, the leg 55 including an offset bridging portion 58 which, in the mounted position of the insert member 54, will lie inwardly adjacent side flange portion 59 of the divider.

The leg 55 includes outer flange portions 60, 61 which lie outwardly adjacent the outer surface of the dividers, whereby the insert member 54 is securely held against the divider.

The divider may include a thin, resilient, vertically directed latching finger 62 having at its lower end a detent shoulder 63 (See FIGS. 2 and 13) and a depending arcuate, forwardly facing cam section 64. The cam 64 functions, when the insert member is forced upwardly into the slots 56, 57, to deflect the latching finger 62 inwardly. After the insert member is fully positioned, finger 62 will snap outwardly, whereby the latching shoulder 63 underlies a portion of the insert member, locking the same in position against accidental downward displacement from the divider.

It will be understood that each of the dividers includes an insert member and that each of the insert members incorporates at its forwardmost end a clamp means 65 next to be described, insertible into the channel 23 of the runner 15, the clamp means 65 being slidable longitudinally of the runner until the divider reaches a predetermined desired position relative to the runner, at which position clamp means 65 may be activated to lock the insert member 54 and, hence, the divider at the selected position.

The clamp means, as best understood from an inspection of FIGS. 9 and 13, comprises an L-shaped lever 66 having an elongate actuator leg 67 and a short locking leg 68. The clamp means 65 extends through an aperture 69 formed in the front leg or plate 70 of the insert member 54. The short leg 68 of the lever includes a pair of laterally extending ears 71, 72, lying adjacent the front face of the plate 70, and a laterally projecting detent shoulder 73 lying adjacent the inner face of said plate. When the short leg 68 of the locking lever 66 is disposed parallel to the plate 70, the total thickness of the legs 68 and 70 is such as to permit the plate 70 freely to slide within the channel (see dot and dash position FIG. 13).

In order to lock the insert member 54 and, hence, the divider with respect to the channel 23, the lever 65 is pivoted to the solid line position shown in FIG. 13, whereby the short leg 68 of the lever will bear forcibly against the front face 23' of the channel 23, wedging the insert member against longitudinal movement relative to the runner.

Figure 14:
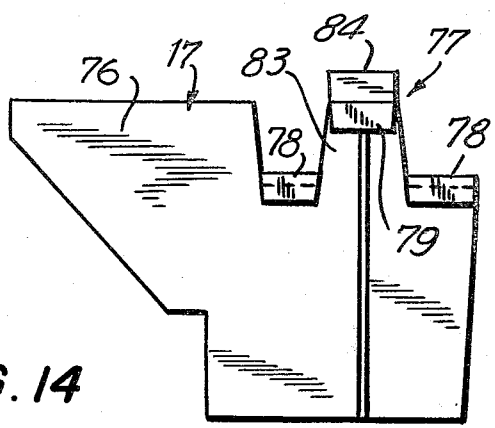
FIG. 14 is a side elevational view of the front bin assembly.

The apparatus preferably includes a front bin assembly 17, best understood from an inspection of FIGS. 1, 3 and 7. The front bin assembly is comprised of two internested segments 74, 75 which are relatively longitudinally extensible. Each segment of the bin assembly 17 includes a side wall portion 76, having formed thereon a hook assembly 77. The hook assembly, as best seen from FIG. 14, includes a lower coplanar pair of hooks 78, 78 and an upper latching hook 79.

The hook assembly 77 is secured to the divider by connection to two of the three vertically displaced slots 80, 81, 82 provided therefore (see FIG. 2). The vertical displacement of hooks 78 from hook 79 corresponds to the displacement of the slots 80, 81, 82 from each other, whereby the hook assembly 77 may selectively be connected to the lower slots 81, 82, as shown in FIG. 2 or, if desired, may be secured to the divider at a higher position by connection with slots 80 and 81.

The latching hook 79 is formed adjacent the end portion of a deflectible tongue member 83. The upper end portion 84 of the deflectible tongue 83, in the assembled position of the latch assembly 77 to a divider, underlies a transversely directed rib portion 85 projecting to both sides of the divider.

In the course of inserting the hooks of the bin into the slots of the divider, the tongue member is deflected inwardly. When the pin is shifted downwardly relative to the divider and the upper edge 84 of the tongue reaches a position beneath the rib, the tongue will snap outwardly until it underlies the rib, whereupon the bin is no longer free to be lifted upwardly, being thus locked to the divider.

The bin sections 74 and 75 incorporate longitudinally directed slots 86, 87. Each of the bin components includes paired tab members 88, 89 which function slidably to lock the base plate portions 90, 91 of the segments 74, 75, respectively, in parallel adjacent planes at all extended or overlapping positions of the segments relatively to each other. Thus, as best seen in FIG. 7, the paired tabs 88 extend upwardly through slot 87 in front bin section 74 and overlie portions of the upper wall 90 thereof, and in similar fashion, paired tabs 89 extend downwardly through slot 86 of bin section 75 and underlie the base plate 91 thereof.

From the foregoing it will be appreciated that the bin sections can be longitudinally extended and contracted and by virtue of the sliding arrangement of the tabs and slots, plates 90 and 91 will be retained in intimate adjacency throughout the range of movement of the bin sections.

Various code or indicia carrying components may advantageously be provided for carrying information relating to the materials stored in the bins. By way of example, a front sign frame member 92 having a carrier hook 93 may be mounted over the front rim 94 of the front rim assembly.

The front sign carrier may include a base plate 95, against which a price card or the like 96 may be mounted. To facilitate mounting of card 96, the plate may include inwardly directed tabs or flanges 97 overlying a portion thereof and retaining the card 96 in position against the base plate.

Similarly, a side sign frame member 98 may be provided for carrying the display card 99, the card being held in position against the frame by inwardly directed tabs 100.

It will be appreciated that the side sign carrier will normally bear different cards on its opposite side faces and thus may incorporate two set of card retainer tabs 100 and 101 for retaining cards 99 and 99', respectively, against the opposite sides of backing plate 102.

The side sign frame member 98 may be mounted to the divider through the use of a series of C-shaped retainer fingers 103 (see FIG. 11), which embrace a dovetail fitting 104 along the front edge 29 of the dividers.

The operation of the device and its adaptability to various shelves or counter arrangements will be readily appreciated from the preceding description.

An organizer kit is supplied, which kit will be comprised of a plurality of runner sections 15, dividers 16, front stop assemblies or bins 17, rear bin assemblies 18, together with a plurality of front and side sign carriers.

The first determination to be made is preferably the length of runner material in accordance with the counter length to be organized. Clamp assemblies 54 are positioned at the lower edges of the dividers, and then sleeved into the channel 23 of the runner 15. The clamp levers of the clamp assemblies 54 are retained in their unlocked position (dot and dash lines, FIG. 13) to enable the dividers to be longitudinally shifted relative to the runner or runners to achieve the desired number and spacing of subdivisions.

Before or after mounting the dividers to the runner in the manner noted, the dividers will be sized as desired by fracturing in vertical and horizontal planes to reduce the size of the dividers to the dimensions of a given shelf or counter configuration.

The runners are next affixed to the underlying shelves by stripping the release covering of the double faced adhesive strip 21 and pressing the runner firmly in the desired position on the shelf.

Back bin assembly or assemblies are thereafter snapped downwardly into position between adjacent divider sections, the wing bolts which clamp the back bin assemblies at a given overlapped position preferably being retained in their loosened or unlocked position during attachment. When the desired relative spacing of the divider members along the runners is achieved, the locking levers 66 of the clamps are thrown, fixing the adjusted position of the dividers along the runner.

Thereafter, the series of front bin assemblies are snapped into position, as noted, and the wing bolts 44 of the back bin assemblies are tightened. Obviously the precise order of assembly need not be followed.

As will be appreciated from the foregoing, the activation of the clamps securing the dividers to the runner, together with the locking of the back bin assemblies in a predetermined widthwisely extending position, will divide the counter into a series of discrete, rigid compartments or semi-enclosures accessible from the front for removal of individual items, such as cans. Normally, the rear of the enclosures will be defined by the back of the counter or shelf and the base of the enclosures by the shelf proper.

Should it be desired to modify the widthwise extent of the individual enclosures, it is merely necessary to release the wing bolts and clamp levers (removal of the front bin assembly being necessary to provide access to the clamp levers) and thereafter expand or contract the relative position of the dividers along the runner, with a concomitant increase or decrease in size of the enclosures. When the desired positioning of the dividers is achieved, they are locked in their reoriented association in the manner previously described.

From the foregoing description it will be evident that there is described a flexible and attractive shelf organization system which enables the effective and efficient management of counter display areas. The device is readily assembled from stock parts and, by virtue of the frangible divider members, is adapted to use on counters and shelves of a wide variety of heights and depths.

The assembly of the unit may be rapidly effected even by unskilled personnel and requires no tools.

Modification of the adjusted position of the parts may be easily accomplished and, if desired, the entire system may be disassembled and stored for subsequent reuse.

The device, which is preferably fabricated of resilient polymeric material, enables the depth of the enclosures to be modified by the simple expedient of forwardly or rearwardly shifting the back bin components within the limits of space available between the front of the shelf and the rear partition.

The component parts are interconnected with a snapping or latching action, taking advantage of the resilient properties of the material of which they are made and assuring that the parts do not inadvertently become disconnected in use.

It will be evident that the system, in various of its aspects, will be useful notwithstanding all of the components are not employed in each subdivision. For instance, the front stop or bin devices need not be included where the device is used with types of articles not requiring a front wall. Likewise, the back bin component may be omitted where the nature of the product stored between dividers is such as to anchor the rear ends of the dividers against lateral deflection. While the clamps for connecting the dividers to the front section are illustrated as comprising metal inserts retained by the dividers, it will be readily recognized that the clamps may be formed integrally with the dividers.

As will be evident to a skilled worker in the art who is apprised of the instant disclosure, numerous variations and modifications of specific aspects of the organizer system may be undertaken without departing from the spirit of the invention which, as defined in the appended claims, is considered to reside in part in the concept of providing frangible divider members having a multiplicity of displaced receiver apertures for securing the other components of the system. Accordingly, the invention is to be broadly construed within the scope of the appended claims.

Having thus described the invention and illustrated its use, what is claimed as new and is desired to be secured by Letters Patent is:

1. An adjustable inventory display device for defining lateral subdivisions of an elongate shelf comprising a plurality of parallel disposed lateral divider members formed of polymeric material, said members including a multiplicity of regularly spaced, vertically and horizontally offset receiver apertures, a plurality of back bin members extending between and connecting said divider members, said back bin members being disposed normal to said divider members and including first and second relatively slidable segments, each said segment including at one end mounting means engaged within receiver aperture portions of one of said dividers, the other ends of said segments being in overlapped relation, a front bin member secured between each adjacent pair of said dividers in forwardly spaced relation to said back bin member, said front bin member being comprised of two segments slidably interconnected, each of said segments having a free end connected to one of said dividers, clamp means formed on said dividers, and an elongate runner member disposed normal to and extending the length between the outermost said dividers, said runner including a longitudinally extending locking channel, said clamp means of said dividers being adjustably fixed within said channel at spaced positions corresponding to the spacing of said dividers whereby said dividers, bins and runner together define a plurality of laterally offset enclosures, the lateral extent of said enclosures being dependent upon the adjusted position of the segments of said back bin and the position of said clamps in said runner.

2. A display device in accordance with claim 1 wherein said receiver apertures are separated by vertically and horizontally disposed score lines, whereby the height and depth of said dividers may be varied by fracturing said dividers along said score lines.

3. A display device in accordance with claim 1 wherein said back bin member includes clamp means for locking said segments in predetermined overlapped relation.

4. A display device in accordance with claim 3 wherein said clamp means includes interengaging corrugated portions on said segments.

5. Apparatus in accordance with claim 1 wherein said mounting means of said segments include integral, resiliently deflectible latch means, and said dividers include latch retainer portions adjacent said apertures, said latch means, in the assembled position of said segments and dividers, being disposed in abutting relation to said retainer portions, whereby said segments are locked against removal from said dividers, said latch means being shiftable laterally to a position clear of said retainer portions to permit disassembly of said mounting means from said dividers.

6. Apparatus in accordance with claim 5 wherein said retainer portions of said dividers comprise a series of horizontally disposed ribs, said ribs being positioned between said receiver apertures laterally to deflect said latch means responsive to movement of said mounting means into said apertures.

7. A display device in accordance with claim 1 wherein said runner member underlies the forward end of said dividers, said runner including a downwardly directed adhesive portion adapted to anchor said runner to a surface disposed therebelow.

8. A multi-compartment display device comprising an elongate runner adapted to be mounted to a horizontal display shelf, a plurality of vertically directed dividers, each including a clamp member adapted to be connected to said runner at any of a variety of positions therealong, said clamp supporting said dividers at adjustably spaced positions along said runner, said dividers being formed of molded polymeric material and including a plurality of vertically and horizontally directed weakened score lines whereby the height and depth of said dividers may be adjusted by fracturing said dividers along selected said score lines, a plurality of regularly spaced horizontally and vertically offset receiver apertures formed in said dividers in predetermined spaced relation to said score lines, a horizontally directed bin member disposed in spanning relation of a pair of said dividers, said bin member including vertically directed planar end walls, each having mounting means formed therein, said mounting means extending through and latchingly engaged within a receiver aperture in said pair of dividers, with said end walls of the said bin in engagement with said dividers, whereby said bin is supported between said dividers and said dividers are braced against said end walls.

9. The device in accordance with claim 8 wherein said mounting means of said bin are engageable with said dividers responsive to movement of said bin relative to said dividers in the direction of the plane of said dividers.

10. A display device in accordance with claim 9 wherein said dividers include horizontally directed rib portions disposed adjacent said horizontally directed score lines, and said mounting means include resiliently deflectible latch portions positioned to be deflected around and to enter behind said rib portions to lock said mounting means to said dividers responsive to said movement of said bins in the direction of the plane of said dividers.

* * * * *